United States Patent [19]

Misumi

[11] 4,079,164

[45] Mar. 14, 1978

[54] BASE METAL PLATE FOR DIRECTLY HEATED OXIDE CATHODE

[75] Inventor: Akira Misumi, Mobara, Japan

[73] Assignee: Hitachi, Ltd., Japan

[21] Appl. No.: 710,161

[22] Filed: Jul. 30, 1976

[30] Foreign Application Priority Data

Nov. 7, 1975 Japan ..... 50-133049

[51] Int. Cl.[2] ..... B22F 3/00

[52] U.S. Cl. ..... 428/353; 75/170; 75/246; 313/345; 313/353

[58] Field of Search ..... 75/170, 246; 27/182; 313/345, 353; 428/553

[56] References Cited

U.S. PATENT DOCUMENTS

| | | | |
|---|---|---|---|
| 2,162,596 | 6/1939 | Wyman | 75/170 |
| 2,720,458 | 10/1955 | Kates | 75/170 |
| 2,833,647 | 5/1958 | Hoff et al. | 75/170 |
| 3,674,710 | 7/1972 | Richter et al. | 75/170 |
| 3,745,403 | 7/1973 | Misumi | 313/345 |
| 3,902,093 | 8/1975 | Weiss | 313/345 |

*Primary Examiner*—Brooks H. Hunt
*Attorney, Agent, or Firm*—Craig & Antonelli

[57] ABSTRACT

A base metal plate for directly heated oxide cathode comprising a plate of Ni-W-Zr alloy containing 20 to 30% by weight of W and 0.3 to 5.0% by weight of Zr, which can further contain a small amount of other reducing element such as Mg, Al, or Si, and having a thickness of not more than 50μ. The base metal plate is prepared by powder metallurgy, and has a good life time of electron emission and a good strength in the operating temperature range of cathode.

16 Claims, 3 Drawing Figures

BASE METAL PLATE FOR DIRECTLY HEATED OXIDE CATHODE

This invention relates to a base metal plate for the directly heated oxide cathode for electron tubes.

In the field of camera tubes, cathode-ray tubes for various observations, television picture tubes, etc. development of the so called quick-start electron tubes capable of being put in operation within about one second after an electric source switch is turned on have been recently in demand, and various systems have been proposed for realizing the quick-start electron tubes.

The present invention provides a base metal plate for the so called directly heated oxide cathode.

The present invention will be described in detail, referring to the accompanying drawings.

Figure 1:
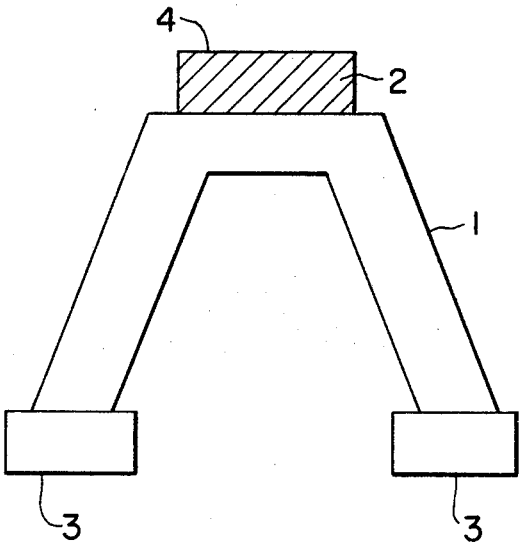
FIG. 1 is a cross-sectional, enlarged view of a structure of directly heated oxide cathode.

As shown schematically in FIG. 1, a directly heated oxide cathode is comprised of a base metal plate 1 and a layer 2 of oxide of alkaline earth metal, an electron emissionable material, deposited to a thickness of 50 to 100$\mu$ onto the base metal plate 1 according to the ordinary procedure. An electric current is directly passed through the base metal plate 1 from one end plate 3 to another to heat the base metal plate 1 and also heat the layer 2 of oxide of alkaline earth metal, thereby effecting thermionic emission from the layer 2 of oxide of alkaline earth metal.

In realizing the directly heated oxide cathode, the most important problem is whether or not a suitable base metal plate can be obtained. The characteristics required for the base metal plate are as follows:

A. Sufficient electron emission can be effected for a long period of time (practically at least 20,000 hours).

B. Sufficient strength should be possessed at an elevated temperature, for example, enough to assure supporting the layer of oxide of alkaline earth metal having a thickness of at least 50$\mu$ in an operating temperature region of 750° to 850° C without any development of deformation, breakage, etc.

C. Electric resistivity should be large enough to prevent any deviation of the cathode temperature from normal operating temperature due to the contact resistance, etc. of electron tube socket or others.

To meet the foregoing characteristics, a Ni-Co alloy has been so far proposed, but is now practically used owing to the low strength at the elevated temperature, and small electric resistivity. Furthermore, Ni alloys containing 20 to 30% by weight of W and an impurity amount of reducing element such as Mg, Si, Al or Zr have been also proposed, but they have no function to maintain electron emission over a longer period of time, as will be described later, though they have satisfactory characteristics in the strength at the elevated temperature, and the electric resistivity.

If it is possible to use directly heated oxide cathode whose base metal plate has a thickness similar to that of the indirectly heated oxide cathode, that is, about 0.2 to about 1.2 mm, a very small amount, for example, an impurity amount of the reducing element could be added to some kind of base metal, for example, Ni as in the indirectly heated oxide cathode, and the resulting base metal could be used, as in the ordinary indirectly heated oxide cathode, to provide a satisfactory directly heated oxide cathode, but such is quite impossible for the following reasons.

As is obvious from electro-heating alloys, etc., the electric resistivity of metal at the operating temperature of oxide cathode, that is, about 750° to about 850° C, is generally not more than 150$\mu\Omega$ cm, and therefore it is necessary to reduce a cross-sectional area of the base metal plate to the current flow so as to assure a sufficiently larger electric resistance of the base metal than the contact resistance of electron tube socket, etc. and also assure the stable cathode temperature in a practical range of current for heating the cathode of electron tube, for example, less than about 1A in the case of television picture tube, whereas an electron-emitting face of the oxide cathode layer (the face designated by numeral 4 in FIG. 1) must be more than a definite area, for example, practically more than a disk area having a diameter of 1.0 mm in the case of television picture tube, to effect normal operation of the electron tube. Therefore, unless the thickness of the base metal plate is made as small as possible, the electric resistance of the base metal plate for heating the cathode cannot be increased to such a range as to permit the electron tube to perform the normal function. According to the study made by the present inventor, it is impossible to design a cathode structure capable of performing the normal function, unless the thickness of the base metal plate is made as small as possible, for example, not more than about 30$\mu$, or not more than 50$\mu$ even at the largest, in the case of color picture tube. Therefore, in the case of the directly heated oxide cathode to be used in the camera tube, cathode-ray tubes for various observations, television pictures tubes, etc., it is necessary that the thickness of the base metal plate be not more than 50$\mu$, preferably not more than 30$\mu$. However, in the case of the base metal plate having such a small thickness, the base metal plate containing a very small amount, that is, an impurity amount, of the reducing element as in the case of the conventional indirectly heated oxide cathode, cannot maintain electron emission from the electron-emissionable oxide deposited on the base metal plate for a practically long period of time.

Figure 2:
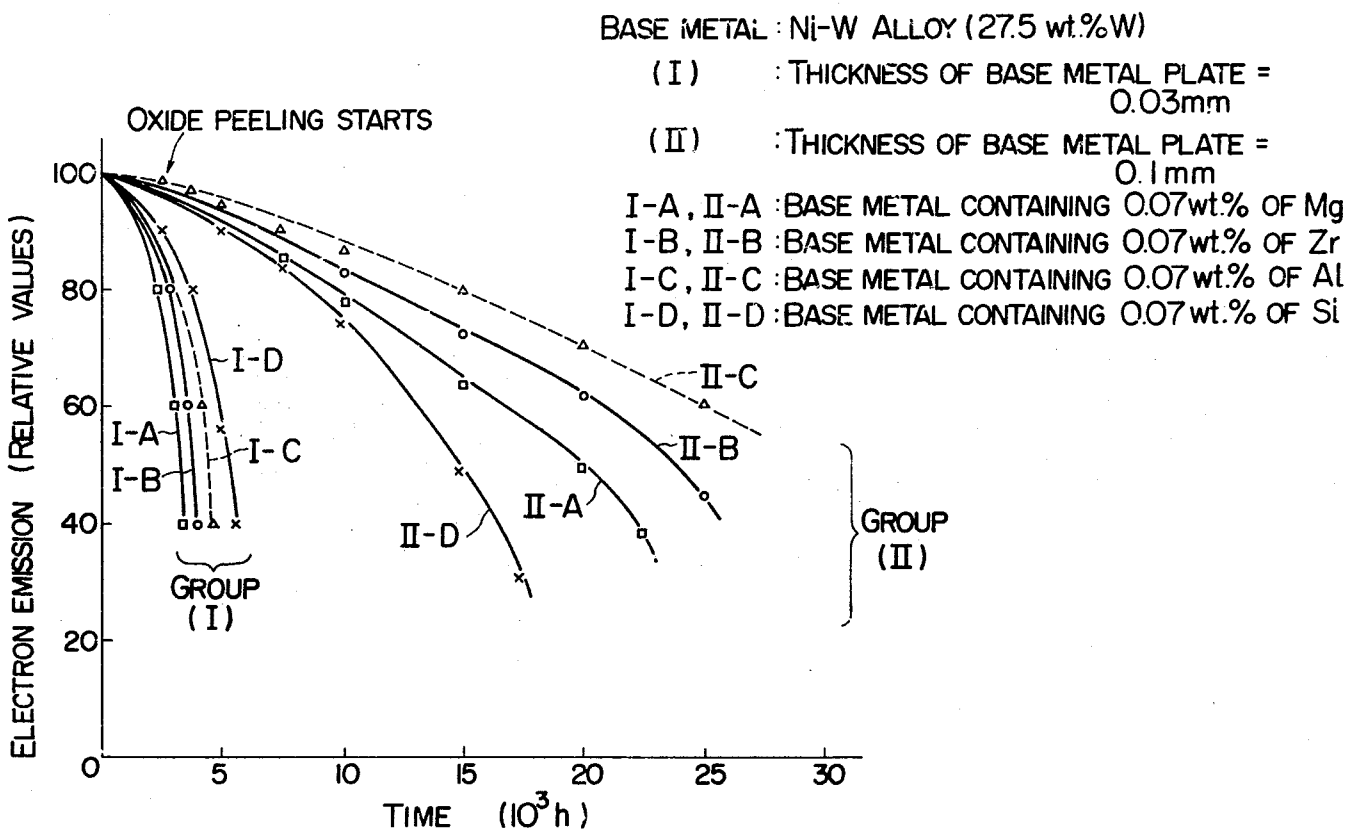
FIG. 2 is a graph showing changes in electron emission with time as regards base metal plates for directly heated oxide cathode containing very small amounts of so far well known various reducing elements and having different plate thicknesses.

For example, cathodes comprised of a base metal plate of Ni-W alloy containing 27.5% by weight of W and a definite amount of Mg, Zr, Al or Si as the reducing element, as proposed so far, (the amount of the reducing element referred to herein being an amount of the element contained in the base metal in such a state as to form, for example, Ba through reaction with the electron-emissionable oxide of alkaline earth metal, for example, Ba, and therefore being excluded from that existing in the state of oxide, carbide, etc. and failing to play a role of the reducing agent), and a layer of oxide of alkaline earth metal for the ordinary oxide electrode, deposited on said base metal plate, are actually inserted in color television picture tubes as a directly heated oxide cathode to measure the electron emission and life time of electron emission. That is, in an oxide cathode comprised of a base metal plate 1 and a layer 2 of oxide of alkaline earth metal for the oxide cathode, deposited on the base metal plate 1, as shown in FIG. 1, changes in electron emission of color television picture tubes with time are measured, where Ni-W alloys containing 27.5% by weight of W and 0.07% by weight of any of Mg, Zr, Al and Si as the typical reducing elements are used as the base metal plates for the cathodes of the picture tubes, while setting the thickness of the base metal plates to 0.03 mm, the thickness that must be used in the directly heated system, and, for corresponding to one-half of 0.2 mm, the thickness used in the ordinary color television picture tubes of indirectly heated oxide cathode now in use. The results are shown in FIG. 2. The reason why the thickness of 0.1 mm is used in place of the thickness of the ordinary indirectly heated type, 0.2 mm, for the comparative purpose is that the 0.2 mm-thick base metal plates are so small in heating resistances for the directly heated type that a large amount of electric current is required for cathode heating, and it is actually impossible to prepare a color television picture tube for such a large amount of electric current.

It is apparent from the graph of FIG. 2, especially analysis of groups (I) and (II), that the life time of electron emission from the cathodes decisively depends upon the thickness of the base metal plate.

In FIG. 2, curves II-A and II-B in group (II) contains 0.07% by weight of Mg and Zr, respectively, as the reducing element, and it has been found by the present inventor that the life time of electron emission shown by curves II-A and II-B is mainly based on consumption of Mg and Zr contaned in the base metal plates, respectively, whereas in the case of the base metal plates containing 0.07% by weight of Al, shown by curve II-C in FIG. 2, a phenomenon of peeling of the oxide of alkaline earth metal from the base metal plate is seen after 3,000 hours from the start of operation, and most of the sample fails to effect electron emission at all after several thousand hours. That is, exact data of life time of electron emission are not obtainable, and thus the dotted line in FIG. 2 means an assumption. The base metal plate containing 0.07% by weight of Si has the characteristics shown by curve II-D in FIG. 2, where the life time of electron emission is mainly dependent upon the presence of an intermediate layer having a high electric resistance formed between Si and the oxide of alkaline earth metal. Once such intermediate layer is formed, a voltage drop at that layer is so large that it is difficult in the actual color television picture tube to make electrons emit from the cathode, failing to maintain a satisfactory function. If a much higher voltage is applied to between the cathode and electron for extracting the electrons to obtain electron emission, the oxide of alkaline earth metal is damaged by the heat generation of the intermediate layer of high electric resistance, ultimately completing the span of the life of the cathode.

On the other hand, the base metal plates of Group (I) in FIG. 2 are the same base metal plates as those of Group (II), but have a different thickness of 0.03 mm, that is, the base metal plates of Ni-W alloys containing 27.5% by weight of W and 0.07% by weight of the same reducing element, Mg, Zr, Al or Si, as that of Group (II) and having a thickness of 0.03 mm. Changes in electron emission with time of the base metal plates of Group (I) are shown by curves I-A for Mg, I-B for Zr, I-C for Al and I-D for Si in FIG. 2. In the case of the base metal plate containing Al, the similar phenomenon of peeling of the alkaline earth metal oxide layer appears, as shown by curve I-C. On the other hand, in the case of the base metal plates containing other than Al, that is, those containing Mg, Zr or Si, the reducing elements contained in the base metal plates are consumed out, and the electron emission is discontinued. That is, in the case of the base metal plates containing Mg, Zr, Al, or Si, which is used as the reducing element for the ordinary oxide cathode, to such a degree as used in the indirectly heated oxide cathode, any practical life time of electron emission cannot be obtained owing to the small thickness of the base metal plate (C as the reducing element is excluded because it has a very short life, as confirmed by the preliminary test made by the present inventor).

As is obvious from the foregoing, the base metal containing a very small amount of the reducing element as has been so far well known, cannot be used in a practically endurable electron tube, because the life time of electron emission is decisively short when the base metal plate has a very small thickness to be used in the directly heated oxide cathode.

To overcome the disadvantages of the prior art as described above, the present inventor has made extensive studies of novel Ni-W-based alloys containing the reducing element not only in an alloy form but also in quite a different form of substance from the well known one, such as an intermetallic compound, to search a drastically novel material on the basis of the study of the conventional oxide cathode using the base metal plate having a large thickness, and, as a result, has found that among the reducing elements only Zr can form the intermetallic compound meeting the characteristics required for the base metal plate for the directly heated oxide cathode.

On the basis of the foregoing finding, the present invention provides a base metal plate for the directly heated oxide cathode, which comprises a Ni-W-Zr alloy plate containing 20 to 30% by weight of W and 0.3 to 5.0% by weight of Zr and having a thickness of not more than 50$\mu$.

Embodiments of the present invention will be described, referring to FIG. 3.

Ni-W alloy plates containing 27.5% by weight of W and varied amounts of Mg, Zr, Al or Si as the reducing element (the amounts of the reducing element being the ones restricted only to the form effectively workable as the reducing agent) and having a plate thickness of 0.03 mm are inserted into color television picture tubes as the base metal plates for the directly heated oxide cathode to measure the life time of electron emission of the respective cathodes, where the life time of the electron emission of the cathodes is defined as a duration of time until the initial value of electron emission has been 50% reduced. The results are shown in FIG. 3.

Figure 3:
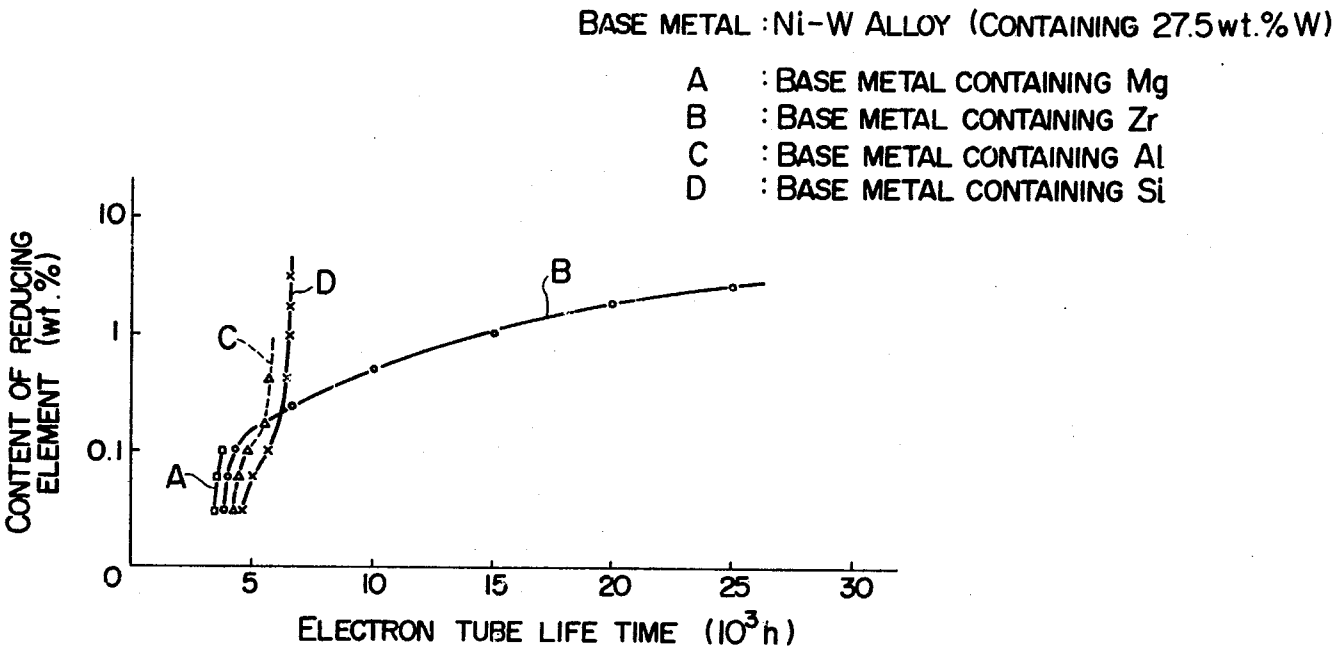
FIG. 3 is a graph showing relations between the contents of Mg, Zr, Al, and Si added to the base metal plates for directly heated oxide cathode and life of electron emission.

Curve A in FIG. 3 is directed to base metals of said Ni-W alloy containing Mg as the reducing element. When the Mg content exceeds 0.1% by weight in the Ni-W-Mg alloy, a low melting compound is formed in the Ni-W-Mg alloy, resulting in considerable decrease in the strength of the alloy of the elevated temperature, and the base metal plate is broken during the life test. The reason why curve A is plotted only up to 0.1% by weight in FIG. 3 is due to this fact. That is, the allowable range for the Mg content in the base metal plate for the directly heated oxide cathode is not more than 0.1% by weight, and the life time of electron emission of the alloy is as short as or shorter than $3 - 4 \times {}^{3}$hr owing to the high Mg consumption rate due to such a small Mg content. The Ni-W-Mg alloy is not practical at all. That is, the Ni-W alloy containing Mg as a principal reducing element is not applied as the base metal for the directly heated oxide cathode.

Curve C in FIG. 3 is directed to base metal plates of the Ni-W alloy containing Al as the reducing element. When the Al content exceeds 0.05% by weight in the Ni-W-Al alloy, a phenomenon of peeling of the alkaline earth metal oxide layer from the base metal plate appears (in FIG. 3, the dotted line of curve C shows the appearance of the peeling phenomenon), and no electrpn emission takes place at all in most of the tested tubes owing to the peeling of the oxide layer. Thus, the Ni-W alloy containing Al as a principal reducing element is not applicable as the base metal plate for the directly heated oxide cathode.

Curve D in FIG. 3 is directed to base metal plates of the Ni-W alloy containing Si as a reducing element. When the Si content exceeds 0.14% by weight in the Ni-W-Si alloy, an intermediate layer having a large electric resistance is formed between the base metal plate and the oxide layer, and the oxide layer, and the electron emission is reduced by the influence of the large electric resistance, and in an extreme case the alkaline earth metal oxide layer is broken by the generated heat of Joule. Thus, the Ni-W alloy containing Si as a principal element is not applicable as the base metal plate for the directly heated oxide cathode.

Curve B in FIG. 3 is directed to base metal plates of the Ni-W alloy containing Zr as the reducing element. In that case, the life time of electron emission is increased with increasing Zr content, as shown by Curve B. This is due to the fact that the Zr solid solution limit in the Ni-W alloy is small (which has been found to be 0.2% by weight in the operating temperature range of the oxide cathode by the present inventor). Even if the Zr content is more increased, the reaction rate of Zr with the alkaline earth metal oxide layer at the initial period of the life is relatively small, that is, almost equal to that when the Zr content is 0.2% by weight. It has been found by the present inventor that Zr deposited as an intermetallic compound, $(Ni\text{-}W)_xZr_y$, is decomposed to compensate the consumption of Zr in the solid solution phase, and the decomposition reaction continues until the intermetallic compound has been consumed out, and thus the intermetallic compound, $(Ni\text{-}W)_xZr_y$, acts as a store house for Zr. It has been also found by the present inventor that the higher the Zr content, the more prolonged the life time of electron emission is. Furthermore, it has been found by the present inventor that, since the intermetallic compound, $(Ni\text{-}W)_xZr_y$, deposited as very fine grains has a high melting point, the Zr content up to 5% by weight gives no substantial influence upon the strength of the base metal plate at the elevated temperature. That is, the base metal plate containing 0.3 to 5% by weight of Zr and having even such a small thickness as 30μ has a satisfactory strength at the elevated temperature and a good life time of electron emission, and is sufficiently practically applicable as the base metal plate for the directly heated oxide cathode. As compared with the base metal plates containing Mg, Al or Si as the reducing element, onlu the Ni-W-Zr alloy can provide a satisfactory material for the base metal plate for the directly heated oxide cathode.

As a result of further extensive studies and tests made by the present inventor on the Ni-W-Zr alloy by varying the Zr content in a range of 0.3 to 5% by weight, and the W content in a range of 20 to 30% by weight, and adding other reducing elements such as Mg, Al, Si, Cu, U, etc. thereto to such small amounts as not to cause any adverse effect, for example, decrease in the strength at the elevated temperature, peeling of the oxide layer, increased resistance of intermediate layer, etc., it has been found that the base metal plates based on the Ni-W-Zr alloy having a thickness up to 50μ can be used as the base metal plate for the directly heated oxide cathode.

It has been also found that thin plates of the Ni-W-Zr alloy containing 20 to 30% by weight of W and 0.3 to 5% by weight of Zr where Zr is uniformly distributed in the alloy can be prepared only according to a powder metallurgical method. That is, the ordinary melting method is not suitable for preparation of an ingot of the alloy, because the material is broken at the initial stage processing of ingot according to the melting method, making it impossible to obtain thin plates, whereas according to the powder metallurgical method, Zr in an amount over the solubility can be distributed uniformly in the alloy, facilitating the processing of thin plates having a thickness of less than 0.001 mm.

What is claimed is:

1. A base metal plate for the directly heated oxide cathode, which comprises a plate of Ni-W-Zr alloy containing 20 to 30% by weight of W and 0.3 to 5.0% by weight of Zr, and said plate having a thickness of not more than 50μ.

2. A base metal plate for the directly heated oxide cathode, which comprises a plate of Ni-base alloy containing 20 to 30% by weight of W, 0.3 to 5.0% by weight of Zr, and a small amount of other reducing element, and said plate having a thickness of not more than 50μ.

3. A base metal plate according to claim 2, where the other reducing element is Mg, Al, Si or C.

4. A base metal plate according to claim 1, wherein said plate has a thickness of not more than 30μ.

5. A base metal plate according to claim 1, wherein Zr is present in said alloy as an intermetallic compound having the formula $(Ni\text{-}W)_xZr_y$.

6. A base metal plate according to claim 3, wherein said plate has a thickness of not more than 30μ.

7. A base metal plate according to claim 3, wherein Zr is present in said alloy as an intermetallic compound having the formula $(Ni\text{-}W)_xZr_y$.

8. In a base metal plate structure for a directly heated oxide cathode including a plate of a Ni-W-Zr alloy, the improvement comprising said plate having a thickness of not more than 50μ, and Zr being present in said alloy in an amount and in a form to be consumed as a reducing element to provide a lifetime electron emission period for said cathode of at least 25,000 hours.

9. A base metal plate structure according to claim 8, wherein said Zr is present in said alloy in the form of an intermetallic compound $(Ni\text{-}W)_xZr_y$.

10. A base metal plate structure according to claim 9, wherein said Zr is present in an amount of 0.3 to 5.0% by weight.

11. A base metal plate structure according to claim 10, wherein said W is present in said alloy in an amount of 20 to 30% by weight.

12. A base metal plate structure according to claim 11, wherein said thickness of said plate is not more than 30μ.

13. A base metal plate structure according to claim 8, wherein said Zr is present in an amount of 0.3 to 5.0% by weight.

14. A base metal plate structure according to claim 8, wherein said W is present in said alloy in an amount of 20 to 30% by weight.

15. A base metal plate structure according to claim 8, wherein said thickness of said plate is not more than 30$\mu$.

16. In a directly heated oxide cathode including a base metal plate and an oxide layer on said base metal plate, the improvement comprising said base metal plate, the improvement comprising said base plate being constituted by a Ni-W-Zr alloy containing 20 to 30% by weight of W and 0.3 to 5.0% by weight of Zr, and said base plate having a thickness of not more than 50$\mu$.

* * * * *